US007392735B2

(12) United States Patent
Brass et al.

(10) Patent No.: US 7,392,735 B2
(45) Date of Patent: Jul. 1, 2008

(54) MANUAL LIQUID METERING DEVICE AND CARTRIDGE

(75) Inventors: Jack Brass, North York (CA); Bjarki Hallgrimsson, Ottawa (CA); Gregory R. W. McEwan, Warkworth (CA)

(73) Assignee: Brasscorp Limited, North York, ON (CA)

( * ) Notice: Subject to any disclaimer, the term of this patent is extended or adjusted under 35 U.S.C. 154(b) by 391 days.

(21) Appl. No.: 10/543,898

(22) PCT Filed: Jan. 29, 2004

(86) PCT No.: PCT/CA2004/000114

§ 371 (c)(1),
(2), (4) Date: Jul. 29, 2005

(87) PCT Pub. No.: WO2004/067962

PCT Pub. Date: Aug. 12, 2004

(65) Prior Publication Data

US 2006/0131344 A1 Jun. 22, 2006

Related U.S. Application Data

(60) Provisional application No. 60/443,532, filed on Jan. 30, 2003.

(51) Int. Cl.
*F04B 9/14* (2006.01)
*F04B 9/04* (2006.01)
*B67D 5/42* (2006.01)

(52) U.S. Cl. ..... 92/32; 222/390

(58) Field of Classification Search ..... 92/32; 222/390

See application file for complete search history.

(56) References Cited

U.S. PATENT DOCUMENTS

D34,226 S 3/1901 Price
1,644,173 A * 10/1927 Carr ..... 222/390

(Continued)

FOREIGN PATENT DOCUMENTS

GB 2 186 544 A 8/1987
JP 06193794 A 7/1994
WO WO 98/12109 A1 3/1998

OTHER PUBLICATIONS

Classic Tool Design Inc., Hand Turn Dye Injectors, 1995, 1 page, New Windsor, USA.
Robinair, The Tracker, 1999-2004, 1 page, Owatonna, USA.
Prime Automotive Warehouse, February Catalog, Feb. 1, 1995, 2 pages, Memphis, USA.
Benco Equipment, Robinair Model 16270 Tracker Injection Kit for R-134a, http://www.benco-equipment.com/products/airconditioning/robinair/Model%2016270.htm, printed Mar. 30, 2005, 1 page, Bismarck, USA.

(Continued)

*Primary Examiner*—Thomas E Lazo

(57) ABSTRACT

Housing is generally tubular and split into two longitudinal hinged halves. Housing receives threads on driver. Retention and anti-rotation means retain cartridge in other end of housing. Cartridge has zero draft tubular wall, and rounds to an extended tip with external threads at other end. Tip is hollow. Piston matching profile to tip and seals open end of cartridge. Liquid is contained between tip and piston. In use, driver engages piston to force liquid out tip. Cartridge differentiates between capacities of cartridge for housing. Driver and housing indicate rotary position of driver with respect to housing and prevent driver from reversing direction. Injector is designed to withstand pressures of operating system to which liquid is injected. Injector high accuracy for use with high concentrations and small cartridges. Cartridge and piston limits introduction of air when filling and limits retained liquid after cartridge used. Housing and driver indicate liquid remaining.

27 Claims, 8 Drawing Sheets

U.S. PATENT DOCUMENTS

| | | | | | |
|---|---|---|---|---|---|
| 2,128,382 | A | | 8/1938 | Tear | |
| 2,745,575 | A | * | 5/1956 | Spencer | 222/390 |
| 2,874,877 | A | * | 2/1959 | Spencer | 222/390 |
| D229,748 | S | | 1/1974 | White et al. | |
| D232,355 | S | | 8/1974 | Wiedmann et al. | |
| 3,898,046 | A | | 8/1975 | Ikeda et al. | |
| D244,555 | S | | 5/1977 | Wiedmann | |
| 4,269,331 | A | * | 5/1981 | Watson | 222/390 |
| D259,440 | S | | 6/1981 | Martin et al. | |
| 4,367,739 | A | | 1/1983 | LeVeen et al. | |
| 4,467,620 | A | | 8/1984 | Bradley et al. | |
| 4,745,772 | A | | 5/1988 | Ferris | |
| 4,810,249 | A | | 3/1989 | Haber et al. | |
| 4,948,016 | A | | 8/1990 | Summons et al. | |
| 4,976,299 | A | | 12/1990 | Bickelman | |
| 5,261,269 | A | | 11/1993 | Barker | |
| 5,551,603 | A | | 9/1996 | Woodruff | |
| D385,793 | S | | 11/1997 | Marsal | |
| 5,699,678 | A | | 12/1997 | Trigiani | |
| 5,826,636 | A | | 10/1998 | Trigiani | |
| D401,697 | S | | 11/1998 | Cloonan et al. | |
| 5,967,204 | A | | 10/1999 | Ferris et al. | |
| 6,050,310 | A | * | 4/2000 | Trigiani | 222/391 |
| 6,056,162 | A | * | 5/2000 | Leighley | 222/390 |
| 6,186,197 | B1 | | 2/2001 | Trigiani | |
| 6,263,778 | B1 | * | 7/2001 | Brass et al. | 92/32 |
| 6,293,319 | B1 | | 9/2001 | Trigiani | |
| D463,024 | S | | 9/2002 | Swenson | |
| RE38,342 | E | | 12/2003 | Trigiani | |

OTHER PUBLICATIONS

Classic Tool Design, Inc., Economy R-12 & R-134a Dye Injector, date unknown, 1 page, New Windsor, USA.

Chemence Limited, Rite-Lok Anacure, date unknown, 1 page, Northants, UK.

AACAD Drafting Service, Cylinder Assembly A/C Sealer and Conditioner, Aug. 13, 1992, 1 page, Dallas, USA.

AACAD Drafting Service, Piston A/C Sealer and Conditioner, Aug. 13, 1992, 1 page, Dallas, USA.

* cited by examiner

MANUAL LIQUID METERING DEVICE AND CARTRIDGE

CROSS REFERENCE TO RELATED APPLICATIONS

This application claims the benefit of the filing date of International Application PCT/CA2004/000114 filed 29 Jan. 2004 which claims the benefit of the filing date of U.S. Provisional Patent Application Ser. No. 60/443,532 filed 30 Jan. 2003 under the same title.

TECHNICAL FIELD

The invention relates to devices for manually metering liquid, and to cartridges for use with such devices. It also relates to such devices for injecting liquids into pressurized systems, such as air conditioning and refrigeration systems.

BACKGROUND ART

Manually metering of liquids can be difficult. This can be seen when one wants to get a certain amount of liquid (but not all of it) out of a tube. The tube collapses and there is no precise way of determining how much has been used or how much is left, short of using a measuring device such as a weigh scale. This is often not practical, particularly where work is being performed on a chargeable basis. Syringes and other injectors have been used for many applications, such as metering of epoxy resins and hardener. They typically lack precision.

Where one is injecting liquids into a pressurized system it may even be difficult simply to inject the entirety of the liquid.

As an example of circumstances where it is desired to meter liquids, injectors are often used in air conditioning and refrigeration systems. Such systems often leak which is undesirable. In air conditioning or refrigeration applications the system will not operate efficiently with reduced quantities of refrigerant. The missing refrigerant needs to be replaced. It is also undesirable as refrigerant can be environmentally damaging when released.

Leak detection can be performed by injecting a fluorescent dye into the system. In air conditioning and refrigeration applications dyes typically used for this purpose fluoresce in the ultraviolet and near ultraviolet region from approximately 360 to 420 nm; so, an ultraviolet light is shone on the system. Wherever leaks occur the dye will escape the system and fluoresce under the light. A pulsing ultraviolet light for this purpose is described in U.S. Pat. No. 5,804,822 issued Sep. 8, 1998 under title Fault Locating Device, System and Method. Many other ultraviolet lights are available.

A number of injectors have been developed for getting liquids into air conditioning and refrigeration systems. Some injectors may also be used to inject other liquids, for example, refrigerant, lubricant and/or other additives into the air conditioning system.

The assignee of the instant application is the owner of U.S. Pat. No. 6,263,778 issued Jul. 24, 2001 under title Precision Liquid Injection System. The system has a spindle with a central bore into which a piston is inserted. The piston and spindle define a chamber that carries the liquid to be injected. A driver sleeve has interior threads that match those on the outside of the spindle. A piston rod is placed inside the driver sleeve. Rotation of the driver sleeve causes the piston rod to drive the piston into the chamber. The liquid escapes through an opening at the end of the spindle and is injected in to the system.

Although the system works well, improvements are desirable as with any product.

It is an object of the invention to provide such improvements, to address other problems associated liquid injectors, or to provide alternative devices.

DISCLOSURE OF THE INVENTION

In a first aspect the invention provides an injector for injecting a liquid into a pressurized system. The injector has a cartridge for containing the liquid, the cartridge having along its longitudinal axis an open end and an opposing partially enclosed end with a connector for connection, directly or indirectly, to the pressurized system, a generally tubular housing for receiving the open end of the cartridge, the housing having internal threads, a driver having external threads compatible with the internal threads of the housing and having a handle. An operator can manually grip the housing while rotating the driver with respect to the housing to force the liquid to be ejected from the cartridge through the enclosed end.

The connector may be a tip extending from the cartridge, the tip having external threads. The handle and the housing where it is to be gripped may be fully accessible to an operator throughout the travel of the driver into the housing. The housing may have a grip formed from a slip resistant material. The material may be a rubber-like material, including rubber.

The housing may have two longitudinal halves. The housing halves may be longitudinally hinged. The cartridge and housing may have anti-rotation means to prevent rotation of the cartridge with respect to the housing about the longitudinal axis of the housing. The cartridge and housing may have retention means to prevent movement of the cartridge along the longitudinal axis of the housing when the injector is connected to the pressurized system.

The housing may have a lock with a first and second position, the lock permitting opening of the housing halves when in the first position and the lock preventing opening of the housing halves when in the second position. The lock and a first of the housing halves may have a slide and track mechanism to permit limited motion of the lock between the first and second positions. The second housing half may have a tab which, when the housing is being hinged open or closed, can pass the lock when the lock is in the first position and cannot pass the lock when the lock is in the second position. The lock may have a lock spring that tends to keep the lock closed when it is closed and tends to keep the lock open when it is open.

The housing and driver may have rotary position indicator means that provide an indication of the rotary position of the driver with respect to the housing. The rotary position indicator means may provide an audible click when aligning to a selected rotary position.

The housing and driver may have anti-reverse means that prevent the rotary movement of the driver with respect to the housing about the longitudinal axis of the housing in one direction, while permitting such motion in the other rotary direction.

The driver may have a longitudinal groove in the threads and the housing may have a lock spring with a latch that springs into the groove when the groove and latch are aligned and that is pushed away by the threads when the groove and latch are not aligned. The groove may have a substantially perpendicular leading edge, and the latch may have a sharply inclined trailing edge. The lock spring may be sufficiently stiff to provide an audible click when the latch enters the groove.

The cartridge and housing may have differentiation means to permit the housing to differentiate between cartridges of different capacities. The housing may have a plurality of locations for cartridges of different capacities. The housing locations may be different to permit the housing to differentiate between cartridges of different capacities.

The cartridge may have an annular flange extending outwardly about the open end, and the housing halves may have respective slots for receiving the flange and limiting movement of the cartridge along the longitudinal axis of the housing. The flange may be asymmetrical about the longitudinal axis of the housing and the slots may be correspondingly asymmetrical to prevent rotary movement of the cartridge about the longitudinal axis of the housing. The flange may have two flat sections opposing one another across the longitudinal axis of the cartridge, and the slots have corresponding flat sections, whereby rotation of the cartridge with respect to the housing is prevented when the cartridge is mounted in the slots.

A first cartridge capacity may have a flange of a first thickness, and with the slots in the housing for that cartridge capacity are of a corresponding size. A second cartridge capacity may have a flange of second thickness greater than the first thickness, and with the slots in the housing for that cartridge capacity of a corresponding second thickness, wherein cartridge of the second capacity cannot be placed in the slots for the first cartridge capacity. A smaller cartridge capacity housing slot may be located further from the housing threads than a larger cartridge capacity housing slot. The housing and driver may have longitudinal indicator means that indicate the amount of liquid remaining in the cartridge. The driver may have indicators or numerical indications longitudinally spaced along its surface. The housing may have means to isolate a given indicator on the driver for the longitudinal position of the driver. The housing may have means to isolate a given indicator on the driver for the rotational position of the driver. The housing may have an indicator window that isolates a given numerical indication on the driver for the longitudinal position of the driver. The numerical indication may be an indication of the amount of liquid left in the cartridge. The numerical indication may be the number of doses left in the cartridge.

The cartridge may be made from a polyolefin. The cartridge may be made from polypropylene generally 0.094 inches thick, the cartridge has a tubular wall section of zero draft and approximate 0.812 inches internal diameter rounding into a converging shoulder with a radius of 0.406 inches. The cartridge may have an annular flange of approximately 1.240 inches external diameter extending about the open end of the cartridge. The flange may have two flats opposing one another across the longitudinal axis of the cartridge and separated by a distance of approximately 1.08 inches. The cartridge may have a 25 dose capacity of liquid fluorescent dye for an automobile air conditioning system. The internal axial tip length of the cartridge may be approximately 0.640 inches and the overall length of the cartridge may be approximately 5.31 inches.

The cartridge may have an annular flange of approximately 1.250 inches external diameter extending about the open end of the cartridge. The flange may have two flats opposing one another across the longitudinal axis of the cartridge and separated by a distance of approximately 1.032 inches. The cartridge may have a single dose capacity of fluorescent dye for an automobile air conditioning system. The internal axial tip length of the cartridge may be approximately 0.640 inches and the overall length of the cartridge may be approximately 2.25 inches.

The driver may be hollow. The cartridge may have a piston having an external profile matching the internal profile of the cartridge in the tip, the piston enclosing the open end of the cartridge to provide a chamber within the cartridge for the liquid. The tip of the cartridge and the tip of the injector may externally align when the piston is fully inserted into the cartridge. The cartridge may be releasably sealed at the tip when the cartridge is filled with liquid. The cartridge may be sealed at the tip with a cap when the cartridge is filled with liquid.

The liquid may contain a fluorescent dye compatible with refrigerant in the pressurized system, for example R12, R22, R134A, R410A, R406, R404, R502 or ammonia refrigerant. The injector may be able to withstand internal pressure of 150 psi. The injector may have no significant deflection at 150 psi. The cartridge may contain a high concentration liquid, for example the liquid may be a liquid fluorescent dye having a concentration such that 1.2 ml of the dye is sufficient to perform leak detection for every 7 lbs of refrigerant in the system or for every 4 lbs of refrigerant on the system.

In another aspect the invention provides a liquid metering device for metering a liquid. The device has a cartridge for containing the liquid, the cartridge having along its longitudinal axis an open end and an opposing partially enclosed end with a tip extending from the cartridge through which the liquid is dispensed from the cartridge, a generally tubular housing for receiving the open end of the cartridge (the housing having internal threads), and a driver having external threads compatible with the internal threads of the housing, and the driver having a handle. An operator can manually grip the housing while rotating the driver with respect to the housing to force the liquid to be ejected from the cartridge through the partially enclosed end.

In other aspects the invention provides metering devices, injectors, cartridges, housings and drivers as set out above and methods of use therefor, and metering devices, injectors, cartridges, housings and drivers and methods of use therefore as further described elsewhere in this description, or as may be based thereon or incorporate various features or uses thereof.

BRIEF DESCRIPTION OF THE DRAWINGS

For a better understanding of the present invention and to show more were clearly how it may be carried into effect, reference will now be made, by way of example, to the accompanying drawings which show the preferred embodiment of the present invention and in which.

MODES FOR CARRYING OUT THE INVENTION

Figure 1:
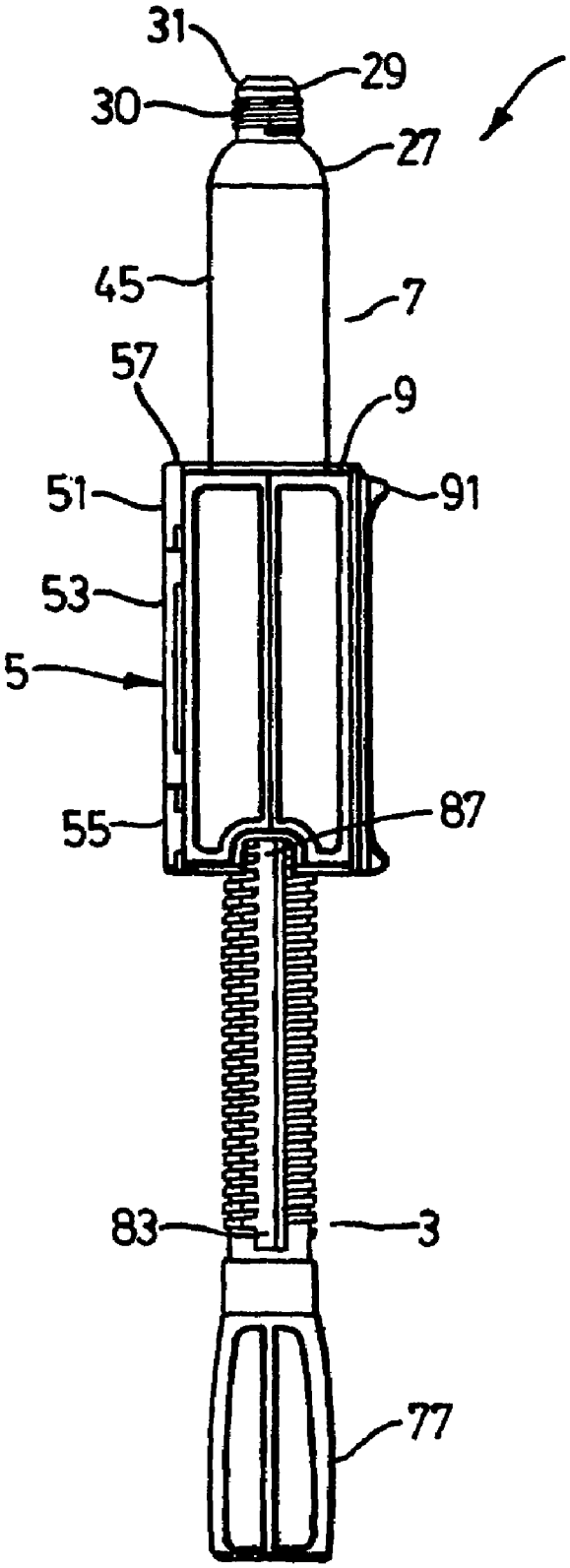
FIG. 1 is a side view from the left of an injector, including cartridge, housing and driver, in accordance with a preferred embodiment of the invention.

In this description similar reference numerals will be used to refer to like parts in different figures, unless otherwise set out in this description. Terms that imply a specific orientation of the parts with respect to the external world do not imply that such an orientation is required, for example the terms "left" and "right", and "bottom" and "top", when used to refer to parts of the preferred embodiment are used for convenience only.

Figure 2:
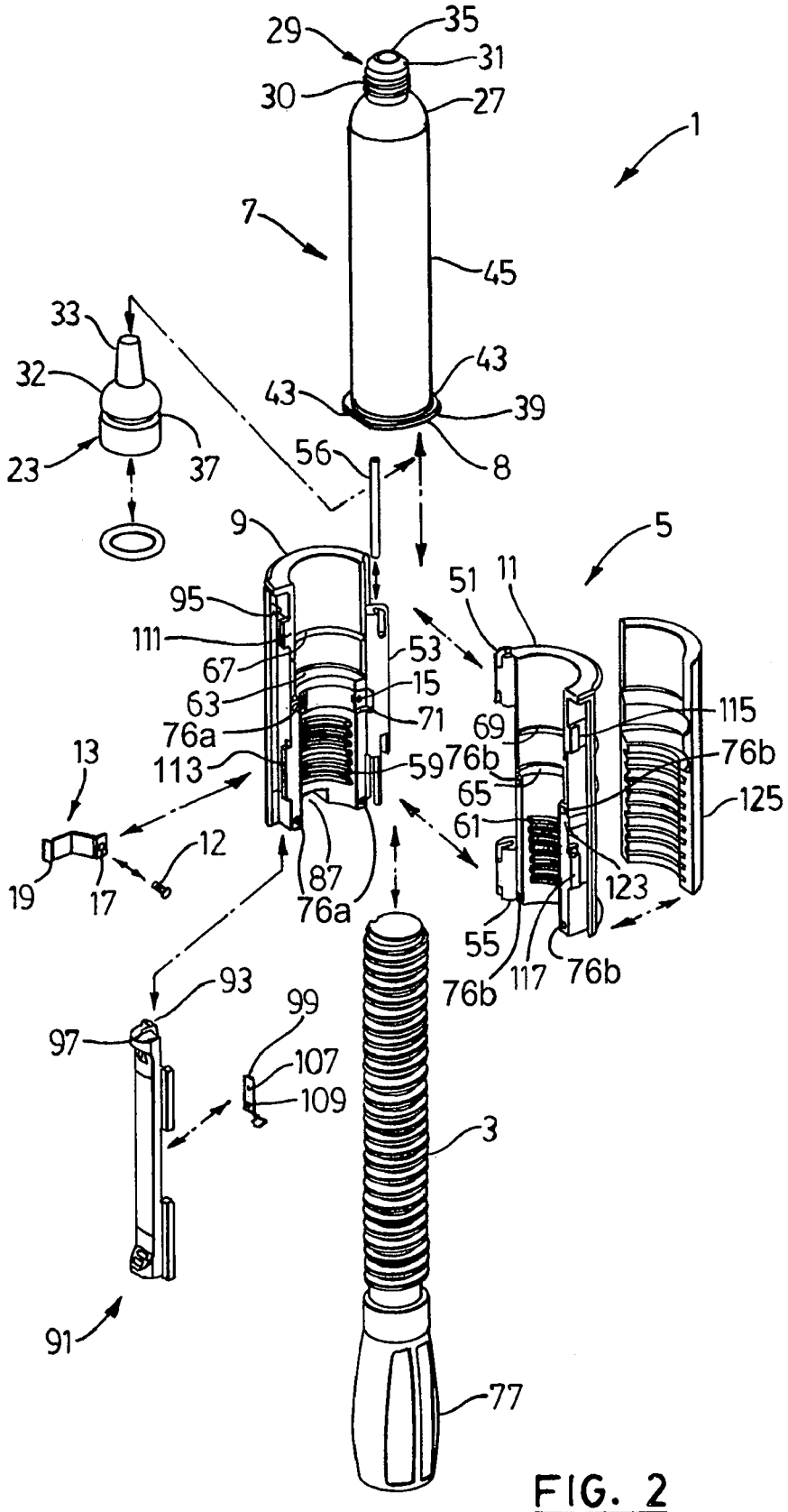
FIG. 2 is an exploded perspective view of the injector of FIG. 1 from above and to the right of the injector.
Figure 3:
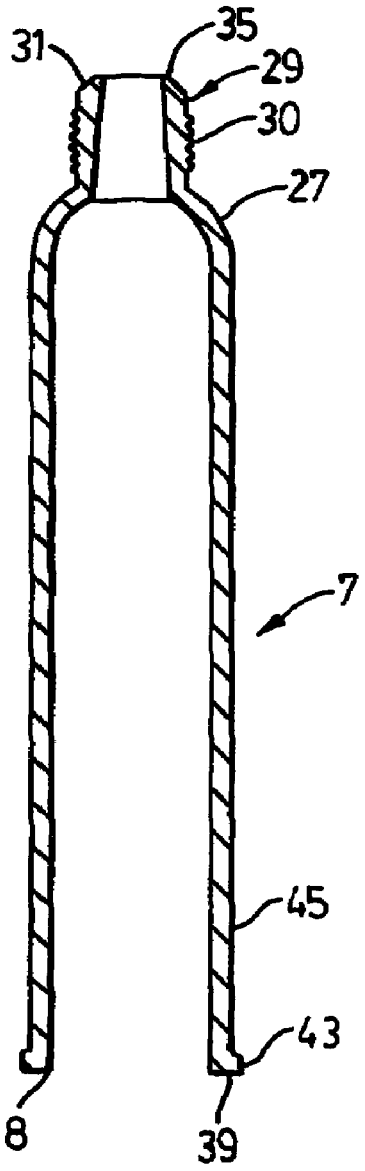
FIG. 3 is an axial cross-section of the cartridge of FIG. 1.
Figure 4:
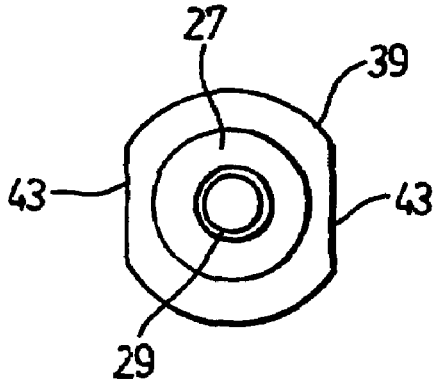
FIG. 4 is an end view of the cartridge of FIG. 1 looking in its open end.

Referring to FIG. 1, liquid metering device 1 will typically be used to inject materials into a pressurized system, not shown. It is to be recognized that the device 1 is particularly beneficial for such applications; however, it is not limited thereto. Towards the end of this description reference is made, for example, to alterations that may be desirable (although not necessary) when the device 1 is used in non-injection applications. As the primary use of the preferred embodiment is for injection applications, the device 1 will now be referred to as injector 1. The injector 1 has a driver 3, a housing 5 and a cartridge 7. Referring to FIG. 2, the housing 5 is generally tubular and is split into two longitudinal halves 9, 11. The housing halves 9, 11 may be formed from a sufficiently stiff material that resists deflection as set out herein, for example glass filled nylon, dye cast aluminum, aluminum or zinc alloys, or sintered metal.

Attached by a screw 12 or otherwise to left half 9 is a first lock spring 13. The lock springs referred to herein are made from spring steel. Many other suitable materials could be used, including sufficiently elastic and resilient plastic. In FIG. 2, hole 15 is aligned with hole 17, so that the screw 12 can be inserted. This correctly orients latch 19 of spring 13 to project away from the left housing half 9.

Referring to FIGS. 1 through 4, cartridge 7 is generally tubular. At one end 8 the cartridge 7 is open to receive a piston 23. At the opposing end, the cartridge 7 is partially enclosed to allow the retention of liquid, while permitting it to be ejected from the cartridge. The cartridge 7 has a rounded shoulder 27 that decreases the dimension of the cartridge 7, and a tip 29, that extends from the shoulder 27. The tip 29 is hollow and has external threads 30. The liquid is dispensed from the cartridge 7 through the tip 29. In the preferred embodiment the threads 30 are ⅝ inches at 18 threads per inch. The threads 30 allow for connection of connectors, such as R134A, R22, R12 or other refrigerant system (for example, R410A, R406, R404, R502 or ammonia) fittings or hoses with such fittings, not shown, that further connect to an air conditioning, refrigeration or other pressurized system, not shown. Such connectors could be integrated with the cartridge 1; however, this may add to the cost and restrict the use of the cartridge to systems that use that particular fitting. Alternatively, separate fittings could be sold with the injector 1, or cartridge 7. No matter which method is used care must be taken to ensure that the liquid in the cartridge is compatible with the other contents of the system into which it is to be injected, for example R12, R134A, R22, R410A, R405, R404, R502 or ammonia air conditioning and refrigeration systems.

The hoses or fittings could have a one-way valve, such as a check valve, that allows liquid flow from the cartridge 7 to the pressurized system, while limiting flow in the reverse direction.

The tip 29 and external threads 30 form a connector for connection, directly or indirectly, to the pressurized system. The tip has a bevelled rim 31 to provide a good seal an o-ring type seal that may be used when connecting fittings or other connectors to the tip 29. Alternative connectors could be used in place of the tip 29. For example, the tip 29 could be inverted to extend into the cartridge with internal threads for connection to the pressurized system. A tip 29 with external threads is preferable as this provides a smooth internal profile against which the piston 23 can rest.

Figure 5:
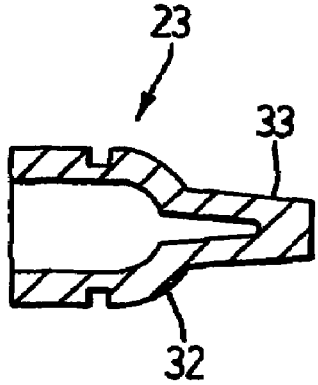
FIG. 5 is an axial cross-section of a piston for use with the cartridge of FIG. 1.

Referring to FIGS. 2 and 5, the piston 23 has an external profile that generally matches the internal profile of the cartridge 7 from above the shoulder 27 through the tip 29. Thus the piston 23 also has a rounded shoulder 32 and a tip 33. When the piston is fully inserted into the cartridge, the tip 33 extends to be flush with distal end 35 of tip 29 (such that the tips 29, 33 are externally aligned). This fully fills the distal end of the cartridge 7. The piston 23 is preferably formed (except for an annular seal to be described) from a hard material such as the same material as the cartridge 7; however, it may be formed from other sufficiently hard materials that are compatible with the liquid to be injected. A hard material limits the amount of deflection in the piston 23 for increased accuracy. Using the same material for the piston 23 as the remainder of the cartridge 7 also facilitates recycling of the cartridge 7.

A groove 37 is provided on the piston 23 above the shoulder 32. An annular seal, such as an O-ring seal, not shown, fits within the groove 37 to seal between the piston 23 and the cartridge 7. The seal is deformable and resilient to fill in the gap between the piston 23 and the cartridge 7. In the preferred embodiment the piston 23 has an external diameter of 0.800 inches, while the internal diameter of the cartridge at the open end 8 is 0.812 inches. Preferably the seal is fairly hard (between 70 and 90 durometer) to reduce the amount of friction between the piston 23 and the cartridge 7. This makes it easier to start the piston 23 in motion when the injector 1 is being used. The piston 23 should have sufficient length on either side of the seal sufficiently close to the cartridge 7 about the seal to prevent rotation (flipping) of the piston 23 within the cartridge 7 that might cause the piston to 23 to jam in the cartridge 7 or to break the seal between the piston 23 and the cartridge 7.

When the piston 23 is inserted into the cartridge 7 it encloses the open end 8 and forms a chamber within the cartridge 7 to contain the liquid.

Referring again to FIGS. 1 through 4, the cartridge 7 is preferably filled through the tip 29 with the piston 23 fully inserted into the cartridge 7. The liquid is introduced under pressure, which causes the piston 23 to move away from the tip 29. When a desired amount of liquid is introduced, the cartridge 7 is releasably sealed at the tip 29, for example with a cap threaded onto the threads 30 or a removable thin plastic or foil glued seal, not shown. Once the tip 27 is sealed the piston 23 will not move as it is also sealed to the cartridge 7 and any such motion would create a vacuum or increase the pressure to retain the piston 23 in position. As the tip 29 and tip 33 begin the fill process flush with one another, the introduction of air into the cartridge 7 is minimized. This can be important for some systems, for example air should not be introduced into conditioning and refrigeration systems.

Also, after the cartridge 7 is fully used virtually all of the liquid is ejected because the profiles of the piston 23 and the cartridge 7 are matched and the tips 29, 33 are flush. This results in less waste and makes the cartridge 7 easier to recycle.

The cartridge 7 has an annular flange 39 that extends outwardly about the proximal end 41 of the cartridge 7. The flange 39 has two flats 43. The flats 43 are generally parallel and oppose one another across the longitudinal axis of the cartridge. The flange 39 is used to retain the cartridge 7 in the housing 5 to limit movement along the longitudinal axis of the housing. As the flange 39 is asymmetrical about the longitudinal axis of the cartridge, the flats 43 are used to prevent rotation of the cartridge 7 in the housing 5. Rotation could loosen connections or twist hoses between the injector 1 and the air conditioning system. It could also tend to wear the housing over time and reduce the accuracy of the injector 1. Other retention means and anti-rotation means could be used, such as a full annular flange, not shown, with one or more stop blocks, not shown, extending from the flange toward the tip 29. A corresponding change would have to be made to the housing 5. Combined retention means and anti-rotation means such as the flange 39 with flats 43 are useful; however, these functions could be separated as would be evident to one skilled in the art.

The injector 1 and the cartridge 7 have many features to increase the accuracy with which a given dose of liquid can be ejected from the cartridge 7. The internal diameter of the cartridge 7 between the shoulder 27 and open end 8 (the "wall" 45) is substantially the same. This is sometimes referred to as "zero draft". The cartridge 7 is a single integrally formed unit most easily manufactured using injection-moulding techniques. A zero draft cartridge is more difficult to manufacture as the plug that forms the inside of the cartridge 7 is more difficult to remove; however, this configuration means that equal linear movements of the piston 23 in the cartridge will result in an equal volume of liquid being ejected from the cartridge 7. Also the back pressure is constant and thus also the applied force. This extra high tolerance allows for better prevention of leakage.

In many applications, for example dye injection applications, the liquid is typically injected into an air conditioning system that is under pressure. The pressure can be as high as 150 psi. The preferred embodiment of the cartridge 7 is designed not to deflect while under pressure of 500 psi or more. The injector 7 is preferably made from polypropylene with a wall thickness of 0.094 inches, overall length (tip 29 to open end 8) of 5.31 inches, internal axial tip 29 length of 0.640 inches, beginning tip 29 opening of 0.4 inches, ending tip 29 opening of 0.3 inches, internal diameter of the wall 45 of 0.812 inches, shoulder 27 radius of 0.406 inches, flange 39 external radius of 1.240 inches, flange 39 thickness of 0.094 inches, distance between flats 43 of 1.08 inches. Alternative cartridge 7 materials dimension and shapes will be evident to those skilled in the art; these specific dimensions are those that have been found to work well for the intended purposes described above. The cartridge 7 is preferably clear or translucent to allow an operator with visual indication of the amount of liquid in the cartridge 7.

Where the liquid is a liquid fluorescent dye, it may have a high concentration such that 1.2 mL or less of the dye is sufficient for each 7 lbs. of refrigerant in an air conditioning or refrigeration system. The cartridge 7 with the dimensions described elsewhere herein provides 1.2 mL per single rotation of the driver 3. The cartridge 7 has a capacity of approximately 30 mL. The cartridge 7 with the above dimensions provides a capacity of 25 shots or doses for a typical automotive air conditioning system when using high concentration dye. Typically automotive systems have approximately 4-7 lbs of refrigerant.

Of course, other capacities of cartridge can be used. Also, the cartridge 7 could be filled more or less so that the piston 23 starts at a different axial depth. The driver could be rotated more than once for higher capacity air conditioning or refrigeration systems, or other applications such as injection of lubricant, stop leak or other additives. High accuracy allows for the use of a high concentration dye. The use of a high concentration dye means a smaller cartridge 7, less waste and less foreign material added to the air conditioning system. A smaller cartridge 7 can also mean higher accuracy as there is less of a tendency for the cartridge 7 to stretch or bulge for the same thickness of material. The injectors described herein are repeatably accurate to within 0.1 ml or less.

The rounded shoulder 27 also adds to the strength of the cartridge 7 as the shoulder 27 does not provide a specific point of failure at lower pressure than the remainder of the cartridge 7.

Figure 6:
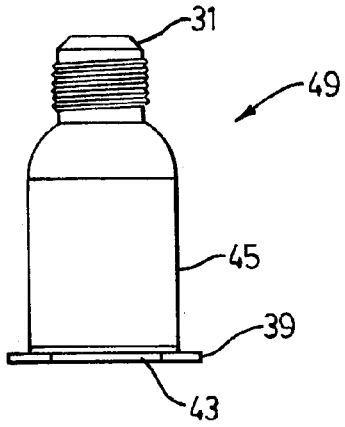
FIG. 6 is a side view of a cartridge in accordance with an alternate preferred embodiment of the invention.
Figure 7:
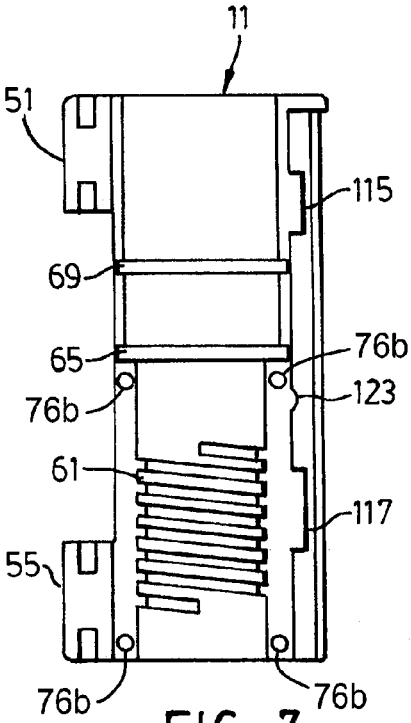
FIG. 7 is a front view of a right half of the housing of FIG. 1.
Figure 8:
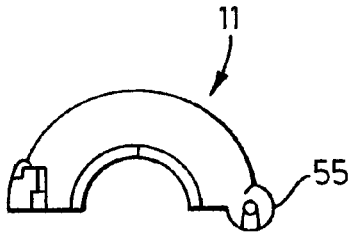
FIG. 8 is an end view of the housing half of FIG. 7 from below.

Referring to FIG. 6, a cartridge 49 is similar to cartridge 7, except that the wall 45 is shortened to provide an overall length of 2.25 inches, flange 39 thickness is 0.070 inches, external flange 39 diameter is 1.250 inches, and distance between flats 43 is 1.032 inches. The reduced length provides a single dye dose capacity. The difference in the thickness of the flanges 39 of the cartridges 7, 49 is utilized to differentiate between the cartridges 7, 49 for the housing 5 as is described elsewhere herein. The difference between the flange diameters and distances between flats 43 of cartridges 7, 49 are not exploited in the preferred embodiment; however, such differences could be used to uniquely differentiate the cartridges 7, 49 for the housing 5 as is described elsewhere herein.

Referring to FIGS. 2 and 7 through 13, housing halves 9 and 11 have alternating longitudinal pin holders 51, 53 and 55 that fit together to receive a single pin 56 and create a clamshell-type longitudinal hinge 57. On a bottom portion of the interior of the halves 9, 11 are threads 59, 61 that are aligned to create a continuous internal thread for receiving the driver 3 when the hinge 57 is closed.

The hinged halves 9, 11 permit easy access to the driver 3 and the cartridge 7 for insertion and removal, and for repositioning of the driver 3. The halves do not have to be hinged in order to do this. The halves 9, 11 could be entirely separable and fit together with locks on either side (similar to the lock 91 that will be described) or other means to releasably attach the housing halves. It is also possible to create housings that do not need to be opened as will be described later.

Figure 9:
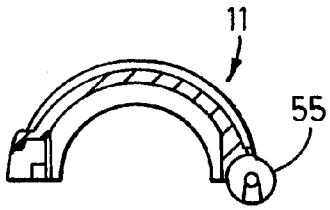
FIG. 9 is a cross-section of the housing half of FIG. 7 through a cartridge slot and looking up.
Figure 11:
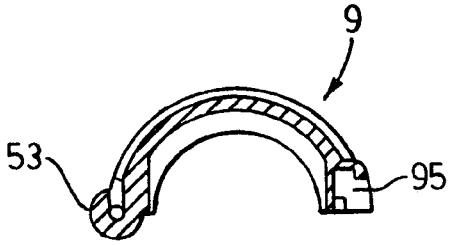
FIG. 11 is a cross-section of the housing half of FIG. 10 through a cartridge slot and looking up.

Each housing half 9, 11 has an annular slot 63, 65 for accepting the flange 39 of cartridge 7 and has an annular slot 67, 69 for receiving the flange 39 of cartridge 49. The slots are dimensioned to snugly retain their respective flanges 39 and to fit against the flats 43 as best seen in FIGS. 9, 11. The difference in the thicknesses of the flanges 39 of cartridges 7 and 49 is reflected in the sizes of the slots 63 through 69. Thus, the cartridge 7 will not fit in the slots 67, 69. This is advantageous as the housing 5 can have a large depth (and thus a large gripping surface) while permitting the tip of cartridge 49 to extend beyond the housing 5 for easy access to the tip 29 for connection, while having the cartridge 7 closer to the threads 59, 61 and reducing the required length of the driver 3.

Although not shown, the cartridges 7, 49 could be uniquely differentiated to the housing 5 by using two different parameters, such as the distance between the flats 43 and the external diameters of the flanges 39, and corresponding sizes of slots 63 through 69. If the distance between the flats 43 of the cartridge 7 were too large then the cartridge would not fit into the slots 67, 69, and if the diameter of the flange 39 of the cartridge 49 was too large then the cartridge 49 would not fit into the slots 63, 65. Thus the cartridges 7 and 49 would be uniquely differentiated for the housing 5. Alternate cartridge capacities and additional housing slots with corresponding unique differentiators could be included as desired.

The two slot positions ensure that the tip 29 of the cartridge 49 is accessible from outside the housing 5, while providing greater lateral support to the longer cartridge 7. Also, the cartridges 7, 49 are correctly matched with different drivers as will later be described. A closer slot position for the cartridge 7 allows for a shorter driver 3 and shorter overall injector 1 length. It is possible to use a single slot position for multiple cartridge capacities and to make the flanges 39 and flats 43 the same size for each cartridge capacity. It is desirable to retain a length of housing 5 that is easy to grip while turning the driver 3 at all axial locations of the driver 3 (throughout the travel of the driver) when the injector 1 is connected to an air conditioning system under pressure.

Figure 10:
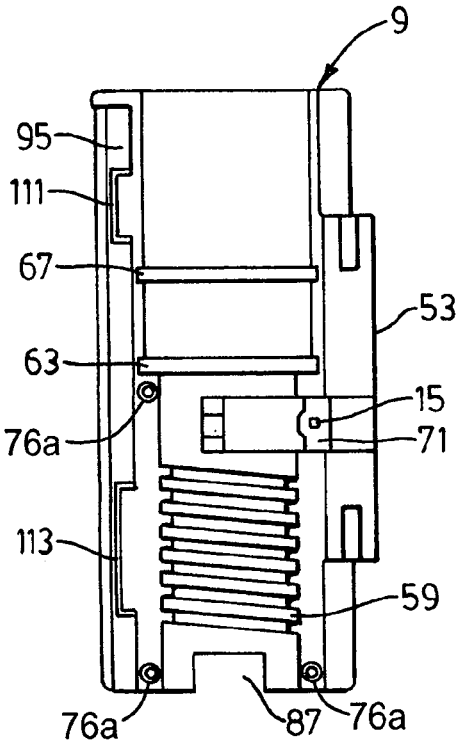
FIG. 10 is a front view of a left half housing of FIG. 1.
Figure 12:
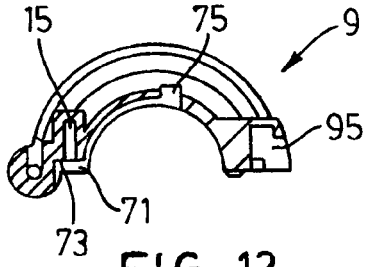
FIG. 12 is a cross-section of the housing half of FIG. 10 through a lock spring mount and looking up.
Figure 13:
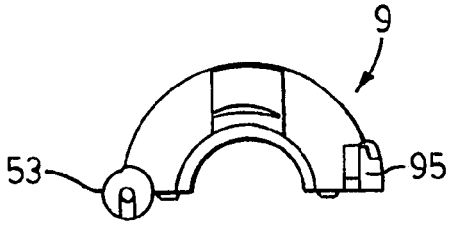
FIG. 13 is an end view of the housing half of FIG. 10 from below.

Referring to FIGS. 2, 10 and 12 the housing half 9 has a lock spring mount 71 indented into the housing half 9 between the threads 59 and the slot 63. The mount has a flat section 73 behind which is hole 15. At the opposite end of the mount 71 is a hollow 75 of greater depth than the general indent of the mount 71. The mount 71 receives the lock spring 13 previously described with reference to FIG. 2. The hollow 75 allows the spring lock 13 to bend away from the housing 5 axis when the latch 19 is pressed, while springing back to its original position when released.

The housing 5 also has locating bosses 76*a* and cups 76*b* on the respective halves 9, 11. This assists in locating (aligning) the two halves 9, 11 with respect to one another when closed. This reduces wear and tear on the hinge 57 and also facilitates proper align of the lock 91 with respect to the tabs 115, 117.

Figure 14:
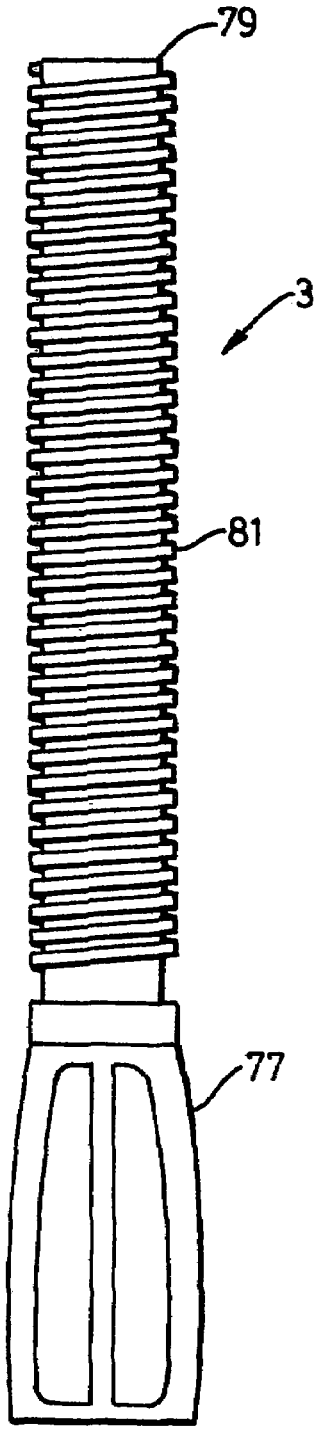
FIG. 14 is a side view of the driver of FIG. 1.

Referring to FIG. 14, driver 3 has a handle 77 and a spindle 79 with external threads 81. Threads 81 match threads 59, 61 of housing 5. The handle 77 is of sufficient length and diameter to be easily gripped. An operator is easily able to maintain purchase on the handle 77 and the housing 5 no matter what the axial position of the driver 3 (throughout the travel of the driver).

The use of a threaded spindle 79 provides a great deal of accuracy. The number of threads per inch will depend on the number of turns desired for a particular dose and the configuration of the cartridge, among other things. In the preferred embodiment a single dose is ejected per full revolution of the driver with 6.8 threads per inch (or a pitch=0.147"). For high accuracy, the various threads, housing halves and other components should also be designed not to deflect at the highest pressure to be encountered. As mentioned previously, the injector 1 was designed to withstand 500 psi. The injector 1 could be designed not to deflect at lesser pressures, preferably above 150 psi. The housing halves 9, 11 and the driver 3 are formed from a hard plastic, although many other materials can be used, including polyolefins (such as polypropylene), metals and composites.

Figure 15:
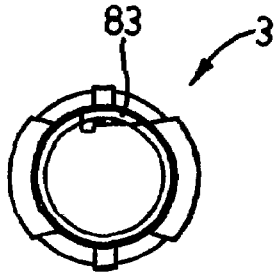
FIG. 15 is an end view of the driver of FIG. 1.

Referring to FIGS. 1 and 15, spindle 79 has longitudinal groove 83 running the length of the threads 81. The groove 83 is shaped to receive the latch 19 of spring lock 13 to provide a positive indication of the rotary position of the driver 3. When the driver 3 is rotated the spring lock 13 is pressed by the threads 81 away from the axis of the housing 5 into the hollow 75. When the groove 83 again meets the latch 19, the spring lock 13 springs the latch 19 back into the groove 83. An audible click can be heard. As the latch 19 has a sharply inclined trailing edge 85 and the groove has a substantially perpendicular leading edge, the driver 3 is prevented from reversing direction and backing out of the housing 5. The housing 5 must be opened in order to reposition the driver 3 further away from the cartridge 7.

Referring to FIGS. 1, 2, 10 and 13, the housing half 9 has an indicator window 87. Along the groove 83 indicator numbers, not show, can be moulded. As the driver 3 is rotated to align the groove 83 and latch 19, an indicator number will appear in the window 87. The window isolates the indicator number. The numbers are selected to provide an indication to an operator of how many doses of liquid have been used or how many are remaining. Typically it will be preferred to indicate the number of doses remaining. Alternatively, the indicator numbers can simply indicate the volume remaining in the cartridge 7, for example 25 ml. The indicator window 87 could be shifted longitudinally along the housing to provide a complete 4-sided window, although this may be more difficult to manufacture. It is not actually necessary to have a specific window 87 as part of an indication means on the housing 5 and driver 3. The driver 3 position indicators could simply be aligned with an edge of the housing 5. A window 87 is preferable as it also provides a positive indication of the rotational position of the driver 3 when the indicators are aligned with the window 87.

The parameters of the driver 3, cartridge 7, and housing 5, such as the cartridge depth and circumference, the threads per inch of the housing and driver, and the location of the cartridge within the housing 5 need to be determined in order to determine the start of the indicator numbers, there spacing and the numbers themselves. Other factors could be the required numbers of rotations per dose. If a dose is 3 revolutions then the indicator numbers may be spaced accordingly. The injectors described herein have many applications and many different dosage levels may be applicable. It will be advantageous to match the numerical indicators to the particular application for a selected injector.

Figure 16:
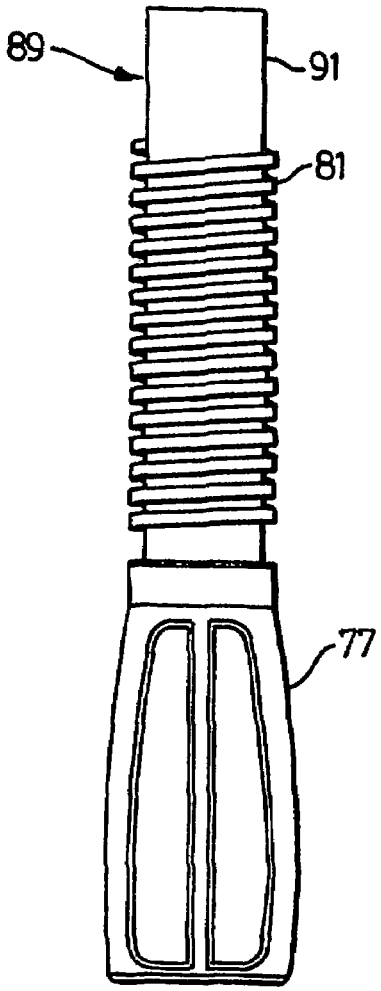
FIG. 16 is a side view of a driver in accordance with an alternate preferred embodiment of the invention for use.

Referring to FIG. 16, a driver 89 is similar to driver 3; however, driver 89 is shorter and has an extended spindle portion 91 without threads 81. The driver 89 may be used with the housing 5 and the cartridge 49. The driver 89 reduces the overall length of the injector considerably. The extended spindle portion 91 compensates for the change in slot position of the cartridge 49. The threads 81 of driver 89 could extend to the end of the driver 89; however, this would require the operator to turn the driver 89 unnecessarily to come into contact with the piston 23. As the driver 89 is used with a single shot cartridge it is not necessary to provide indicator numbers in groove 83, although this may be done. Although it is not necessary, it is still desirable to have a groove 83 to retain the latch 19 for positive indication of distance travelled and prevent to prevent back rotation of the driver 3.

Figure 17:
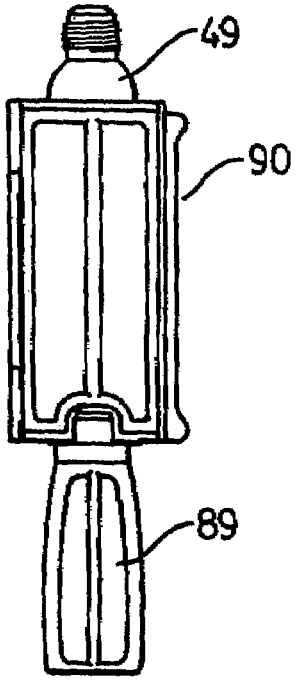
FIG. 17 is a side view of an injector in accordance with an alternate preferred embodiment of the invention, using the housing of FIG. 1, the cartridge of FIG. 6 and the driver of FIG. 16.
Figure 18:
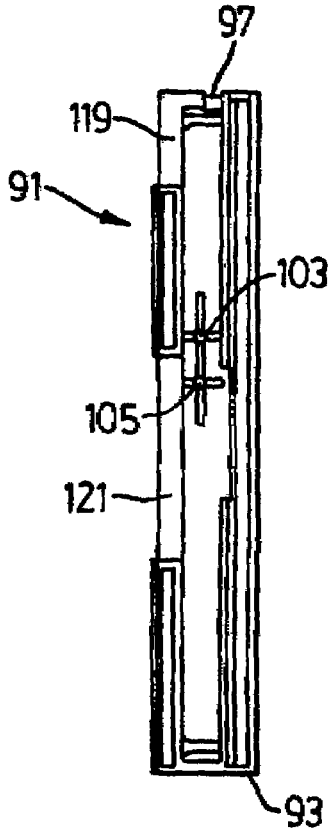
FIG. 18 is a rear view of a lock used with the housing of FIG. 1.
Figure 19:
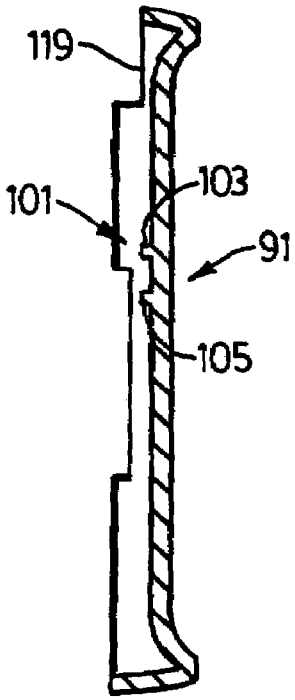
FIG. 19 is a longitudinal cross-section of the lock looking to the right.

Referring to FIG. 17, it is evident that device or injector 90, using cartridge 49 in combination with driver 89, results in a much shorter length.

Referring to FIGS. 1, 2, 18 and 19, lock 91 has a slide 93 along one edge that fits within a corresponding track 95 in the left housing half 9. There is a cut-out 97 at one end of the slide 93 to allow the lock 91 to pass the housing half 9. A second spring lock 99 is mounted to a lock mount 101 inside the lock 91 on pins 103, 105 through holes 107, 109. The pins 103, 105 are melted to weld the spring lock 99 to the mount 101. Other retention means, such as screws, could be used.

The halves 9, 11 have two pairs of tabs 111, 113 and 115, 117 that abut one another when the housing 5 is closed. The lock 91 has cut-outs 119, 121 to allow the tabs 115, 117 of the right half to pass under the lock 91 when the lock is in a first lower position. When the lock 91 is moved upwardly to meet the housing 5, the cut-outs 119, 121 also move upwardly and the tabs 115, 117 are retained by the lock so that the halves 9, 11 cannot be separated.

After the lock 91 is closed, the lock 91 is urged toward the closed position by spring lock 99 moving against bump 123 on right half 11. An operator can open the lock 91 by overcoming the resistance provided by the spring lock 99 and bump 123 combination to cause the spring lock 99 to pass over the bump. The bump 123 then tends to keep the lock 91 open.

The spring lock 99 also prevents the lock 91 from sliding completely out of the housing because the free end of the spring lock 99 will abut the tab 113 and not be allowed to pass over it.

Figure 20:
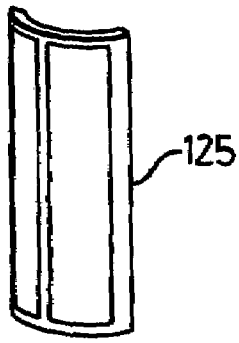
FIG. 20 is a rear perspective view of a rubber-like grip from FIG. 1.

Referring to FIGS. 1, 2 and 20, the right half 11 is finished by a rubber-like (such as rubber) grip 125 that provides a comfortable slip resistant surface for the operator to grip. The material used in the preferred embodiment is Santoprene™. The grip could be formed of other material, such as solid plastic. The grip 125 fills in the external contour of the half 11 and may be glued or otherwise affixed thereto. The left half 9 has a similar grip, not shown, that fills in the contour of the left half 9. Other finishes are possible. For example, the housing halves 9, 11 could each be moulded to provide a grip surface in a unitary construction. The grip surface could have a non-flat contour for additional grip, for example ridges that generally match those of a hand. The grip 125 is fully accessible for the operator to obtain purchase no matter what the axial location of the driver 3.

Figure 21:
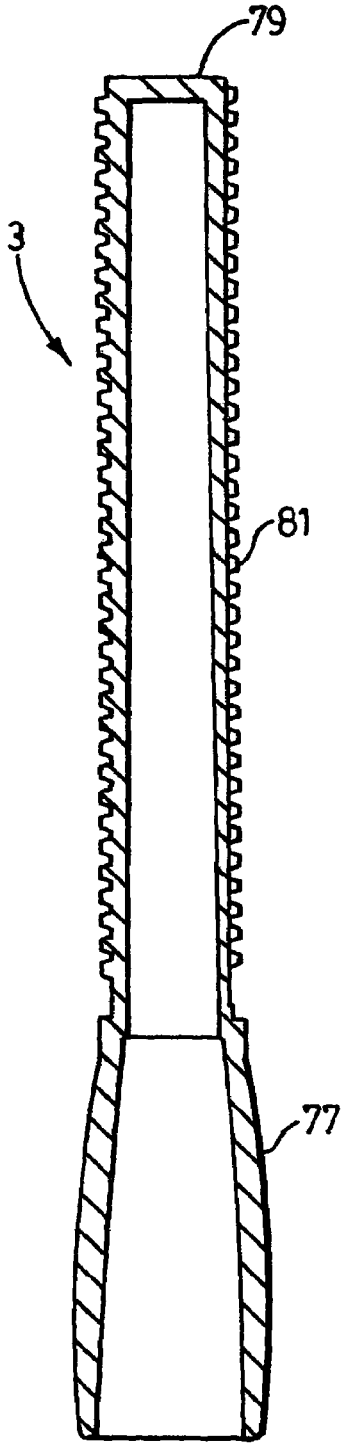
FIG. 21 is a cross-section of the driver of FIG. 1.

Referring to FIG. 21, the driver 3 may be hollow to reduce the amount of material used and increase the speed of manufacturing by reducing curing time. Other drivers, such as driver 89, may be similarly hollowed.

In operation, the housing 5 is unlocked by sliding the lock 91 downwardly. The housing 5 is opened by unhinging the housing halves 9, 11. A cartridge 7 is placed in slot 63 or 65, or a cartridge 49 is placed in slot 67 or 69. Driver 3 may be placed in the same half 9 or 11 as the cartridge 7 or 9, or, alternatively, if cartridge 49 is used, driver 49 may be used. The housing is then closed by re-hinging the halves 9, 11 and sliding the lock 91 upwardly. If a driver has not already been placed in the housing 5, one may be threaded in until the indicator numbers and/or spring lock 13 indicate that the driver is in the correct position. The cartridge 7 or 49 is unsealed and an appropriate connector is threaded onto the tip 29. The connector is then connected, directly or indirectly, to an air conditioning system. The operator checks to see the starting position in the indicator window 87. The handle 77 is gripped and rotated causing the spindle 79 to thread its way into the housing 5 and engage the piston 23. This moves the piston 23 forward and forces liquid out of the injector 1 into the air conditioning system. When the spring lock 13 re-engages the groove 83 this can be felt by the operator and/or an audible click may be heard. The operator can check at the window 87 if the required dose has been injected. The cartridge 7 or 49 can be removed between uses or after it has been emptied by reversing the process described above.

The injectors and components described herein may also be used to inject other liquids, for example, refrigerant, lubricant and/or other additives into an air conditioning system. The size of the components and the doses may need to be changed for practical use.

Figure 22:
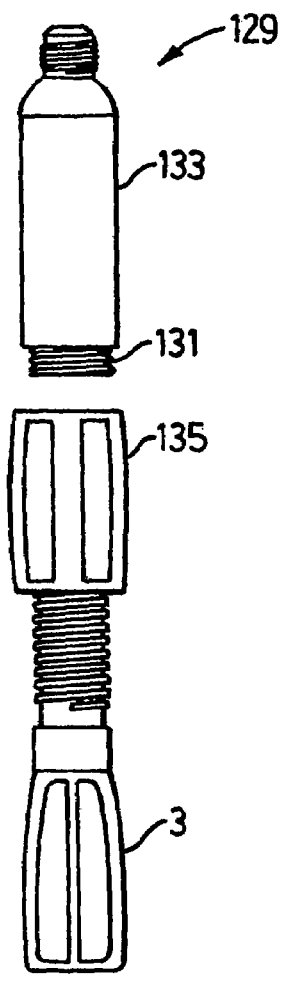
FIG. 22 is a partially exploded perspective view of an injector, cartridge and housing in accordance with an alternate embodiment of the present invention.

Referring to FIG. 22 a device or an injector 129 could have threads 131 on the open end of a cartridge 133 in place of the flange 39. A housing 135 would then have corresponding threads in place of the slots 63, 65, 67, 69. The cartridge 133 could otherwise be similar to cartridge 7 or cartridge 49. The housing 135 could otherwise be similar to the housing 5. Threads 131 would preferably be in the opposite direction of the threads 59, 61 to limit unthreading the cartridge 129 from the housing 135 when the injector 129 is in use.

Alternatively, the housing 135 could be formed as a single unit that does not open. The housing 135 would have threads at opposite ends to receive the driver 3 and the cartridge 129. An anti-reverse feature and a rotary position indicator feature could continue to be provided by accessing latch 19 through the housing 135 to pull it out of the groove 83 and permit the driver 3 to be reversed out of the housing 135 after use. It is a disadvantage of the unitary housing that the driver 3 must be manually threaded out of the housing. In split housing 5 it can be simply opened to allow removal or relocation of the driver 3.

Figure 23:
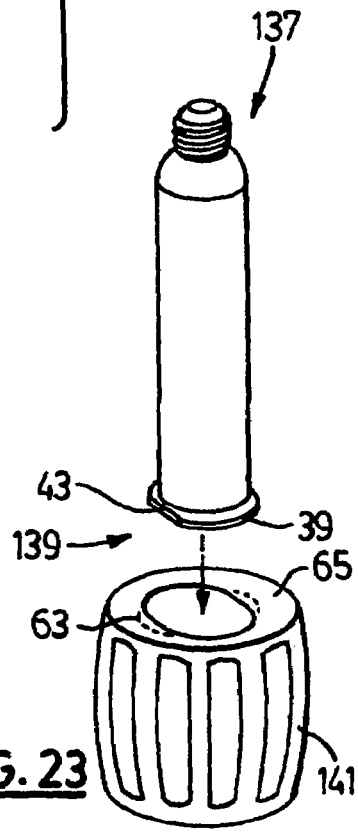
FIG. 23 is a partially exploded view of an injector, cartridge and housing in accordance with a further alternate embodiment of the present invention.

Referring to FIG. 23, a device or an injector 137 (with driver 3 not shown) could have a bayonet-type mounting system 139, where housing 141 has a fitted axial passageway 143 that permits the open end 8 of the cartridge 7 to pass into housing 141 when the cartridge 7 is in one rotary position, and not to pass into the housing when the cartridge 7 is in another rotary position. In this system 139 the cartridge takes the part of the bayonet and the housing 141 has bayonet receivers opening into the passageway 143 that permit the cartridge 7 to be rotated into the second rotary while preventing axial motion of the cartridge 7. The housing 141 could be similar to the housing 5 with the passageway 143 extending at least through to the bottom slots 63, 65. The flanges 39 with flats 43 (as they are asymmetrical about the axis of the cartridge) could perform the bayonet mount function on the cartridge 7, while the slots 63, 65, 67, 69 could then be extended more fully about the axis to permit the flanges 39 to enter from the passageway 143. Slot pair 67, 69 is shown in FIG. 23 with the hidden bayonet receiver portion 145 shown in dash outline. The slots pairs 63, 65 and 67,69 may not be fully annular (having a stops) so that the cartridge 7 is not rotated back into line with the passageway 143. Once mounted, pressure from the driver 3 may tend to keep the cartridge 7 in place. It may be preferable to have supplementary means, such as a friction fit, spring lock mechanism or other means used in bayonet mounting systems.

An alternative bayonet mounting system 139 could be used, such as opposing pins that fit into a groove that initially opens parallel to the longitudinal axis and then in an arc about the longitudinal axis. The pins could be on the housing 141 and the groove on the cartridge 7, or vice versa.

Again, the housing 141 could be a single unit that does not open as discussed for the housing 135. Having cartridges that are releasably mountable on a housing without having to open the housing, such as those described above, may be preferable in some applications or for some users. Many other such releasable mounting systems are possible, including other bayonet mounting systems.

The injectors 129, 137 are used in a similar manner to the injector 1. It will likely be easier to mount the cartridges into the injectors 129, 137 after the housing are closed. Obviously this will be necessary when using a unitary housing that does not open. It will also be necessary to thread the driver 3 into the housing when using a unitary housing. This may be done by choice if a split housing is used.

As mentioned previously, the injectors described herein may be used in many applications in different configurations. Not all features are necessary or beneficial in all applications. Having a positive indicator of rotational position allows an operator to work quickly and accurately without concern that too little or too much liquid will be injected. A longitudinal indicator allows the operator to know how much liquid is being ejected (subtracting beginning and ending indications) and how much is left. The high accuracy features mean that the same amount of fluid is ejected at all times and the back-pressure felt by the operator is consistent, for repeatable accuracy. Reduction of waste materials and the ability to recycle can also be significant benefits.

These benefits can be applied anywhere liquid is to metered. For example, two injectors could be used, one with epoxy resin and the other epoxy hardener. These are typically applied in a given ratio, for example 3:1. By having numerical indicators of dosage that are spaced apart three times on one injector as compared to the first, a user can easily see eject the correct dosage of each liquid. A high accuracy metering device will improve the accuracy of the mix and the quality of the resulting product. In such an application it would typically not be necessary to have a connector, so the threads 30 could be removed and the bevel 31. The profile of the tip 29 can be changed to suit the application. As well, the rounded shoulder 27 may not be required in lower pressure applications. In this case, the injectors are better termed manual liquid metering devices as the liquid will be ejected from the cartridge, but may not be injected into another system, pressurized or otherwise.

It will be understood by those skilled in the art that this description is made with reference to the preferred embodiment and that it is possible to make other embodiments employing the principles of the invention which fall within its spirit and scope as defined by the following claims.

What is claimed is:

1. An injector for injecting a liquid into a pressurized system, the injector comprising:

a. a cartridge for containing the liquid, the cartridge having along its longitudinal axis an open end and an opposing partially enclosed end with a connector for connection, directly or indirectly, to the pressurized system, b. a generally tubular housing for receiving the open end of the cartridge, the housing having internal threads, and c. a driver having external threads compatible with the internal threads of the housing, and the driver having a handle, wherein the housing includes internal threads and the housing is split into a plurality of releasably attached sections for access to the driver and cartridge, and an operator can manually grip the housing while rotating the driver with respect to the housing to force the liquid to be ejected from the cartridge through the partially enclosed end.

2. The injector of claim 1 wherein the connector is a tip extending from the cartridge, the tip having external threads.

3. The injector of claim 2 wherein the cartridge further comprises a piston having an external profile matching the internal profile of the cartridge in the tip, the piston enclosing the open end of the cartridge to provide a chamber within the cartridge for the liquid.

4. The injector of claim 3 wherein the piston has a tip within the external profile, and the tip of the cartridge and the tip of the piston externally align when the piston is fully inserted into the cartridge.

5. The injector of claim 1 wherein the handle and the housing where the housing is to be gripped are fully accessible to an operator throughout the travel of the driver into the housing.

6. The injector of claim 1 wherein the housing has a slip resistant grip.

7. The injector of claim 1 wherein the releasably attached sections of the housing comprise two longitudinal halves of the housing.

8. The injector of claim 7 wherein the housing has a lock with a first and second position, the lock permitting opening of the housing halves when in the first position and the lock preventing opening of the housing halves when in the second position.

9. The injector of claim 8 wherein the lock and a first of the housing halves have a slide and track mechanism to permit limited motion of the lock between the first and second positions.

10. The injector of claim 8 wherein the second housing half has a tab which, when the housing is being hinged open or closed, can pass the lock when the lock is in the first position and cannot pass the lock when the lock is in the second position.

11. The injector of claim 8 wherein the lock has a lock spring that tends to keep the lock closed when the lock is closed and tends to keep the lock open when the lock is open.

12. The injector of claim 1 wherein the cartridge and housing have anti-rotation means to prevent rotation of the cartridge with respect to the housing about the longitudinal axis of the housing.

13. The injector of claim 1 wherein the housing and driver have rotary position indicator means that provide an indication of the rotary position of the driver with respect to the housing.

14. The injector of claim 13 wherein the rotary position indicator means provides an audible click when aligning to a selected rotary position.

15. The injector of claim 1 wherein the housing and driver have anti-reverse means that prevent the rotary movement of the driver with respect to the housing about the longitudinal axis of the housing in one direction, while permitting such motion in the other rotary direction.

16. The injector of claim 1 wherein the driver has a longitudinal groove in the threads and the housing has a lock spring with a latch that springs into the groove when the groove and latch are aligned and that is pushed away by the threads when the groove and latch are not aligned.

17. The injector of claim 16 wherein the groove has a substantially perpendicular leading edge, and the latch has a sharply inclined trailing edge.

18. The injector of claim 17 wherein the spring lock is sufficiently stiff to provide an audible click when the latch enters the groove.

19. The injector of claim 1 wherein the cartridge and housing have differentiation means to permit the housing to differentiate between cartridges of different capacities.

20. The injector of claim 1 wherein the housing has a plurality of locations for cartridges of different capacities.

21. The injector of claim 20 wherein the housing locations are different to permit the housing to differentiate between cartridges of different capacities.

22. The injector of claim 1 wherein the housing and driver have longitudinal indicator means that indicate the amount of liquid remaining in the cartridge.

23. The injector of claim 1 wherein the driver has indicators longitudinally spaced along its surface.

24. The injector of claim 1 wherein the driver has numerical indications longitudinally spaced along its surface.

25. The injector of claim 1 wherein the releasably attached sections are split longitudinally.

26. The injector of claim 25 wherein the sections are longitudinally hinged.

27. The injector of claim 26 wherein the housing has a lock with a first and second position, the lock permitting hinged opening of the sections when in the first position and the lock preventing opening of the sections when in the second position.

* * * * *